US007951758B2

(12) United States Patent
Sandu et al.

(10) Patent No.: US 7,951,758 B2
(45) Date of Patent: May 31, 2011

(54) METHOD OF INCREASING HYDROLYTIC STABILITY OF MAGNESIUM OVERBASED PRODUCTS

(75) Inventors: Corina L. Sandu, Pearland, TX (US); Lawrence N. Kremer, The Woodlands, TX (US); Christine Ann Blundell, Ormskirk (GB); Lee Michael Howard, Prescot (GB); Joseph L. Stark, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 388 days.

(21) Appl. No.: 12/140,481

(22) Filed: Jun. 17, 2008

(65) Prior Publication Data

US 2008/0318816 A1 Dec. 25, 2008

Related U.S. Application Data

(60) Provisional application No. 60/945,794, filed on Jun. 22, 2007.

(51) Int. Cl.
*C10M 159/12* (2006.01)
*C10M 159/24* (2006.01)
*C10L 1/24* (2006.01)

(52) U.S. Cl. ..... 508/232; 508/242; 508/290; 508/391; 508/454; 508/457; 44/373; 44/386

(58) Field of Classification Search ..... 508/232, 508/391, 454, 542, 242, 457
See application file for complete search history.

(56) References Cited

U.S. PATENT DOCUMENTS

| | | | | | |
|---|---|---|---|---|---|
| 4,163,728 | A | | 8/1979 | Cheng et al. | |
| 4,179,383 | A | | 12/1979 | Cheng et al. | |
| 4,328,111 | A | * | 5/1982 | Watson et al. | 508/393 |
| 4,560,490 | A | * | 12/1985 | Denis et al. | 508/239 |
| 4,906,252 | A | * | 3/1990 | Gutierrez et al. | 44/335 |
| 4,927,519 | A | | 5/1990 | Forester | |
| 4,931,164 | A | | 6/1990 | Dickakian | |
| 5,182,038 | A | * | 1/1993 | Shirodkar et al. | 508/292 |
| 5,672,570 | A | * | 9/1997 | Miyaji et al. | 508/192 |
| 5,858,208 | A | | 1/1999 | Flanders et al. | |

(Continued)

FOREIGN PATENT DOCUMENTS

EP 0266872 A1 5/1988

(Continued)

OTHER PUBLICATIONS

Baker Petrolite, "Vanadium Corrosion Inhibitor Using KI-200 Magnesium Fuel Oil Additive", Technical Bulletin, Jul. 2003.
Liquid Minerals Group, "LMG-30E Vandium and SO3 Inhibitor Additive," Specification Sheet.

*Primary Examiner* — Ellen M McAvoy
*Assistant Examiner* — Taiwo Oladapo
(74) *Attorney, Agent, or Firm* — Mossman Kumar & Tyler PC

(57) ABSTRACT

The hydrolytic stability of magnesium overbased products is significantly improved by the addition or inclusion of a mixture or reaction product of an alkylphenol resin with a mixture of an alkenyl succinic anhydride and the acid thereof, and an alkyl amine. These magnesium overbased products are useful additives to fuel oils to improve their corrosion-causing tendencies. In one non-limiting embodiment, the alkylphenol resin is nonylphenol resin and the succinic anhydride is a partially hydrolyzed succinic anhydride having from 14 to 26 carbon atoms, along with the acid thereof. The mixtures and reaction products also serve as asphaltene inhibitors in the fuel oils.

25 Claims, 1 Drawing Sheet

U.S. PATENT DOCUMENTS

| | | | | |
|---|---|---|---|---|
| 5,955,404 | A * | 9/1999 | Horodysky et al. | 508/294 |
| 6,197,075 | B1 | 3/2001 | Muir et al. | |
| 2004/0262198 | A1 | 12/2004 | Siskin et al. | |
| 2005/0040072 | A1 | 2/2005 | Respini et al. | |
| 2005/0199530 | A1 | 9/2005 | Stark et al. | |
| 2005/0263439 | A1 | 12/2005 | Stark et al. | |
| 2008/0099722 | A1 | 5/2008 | Stark et al. | |

FOREIGN PATENT DOCUMENTS

| | | | |
|---|---|---|---|
| EP | 0267674 | A1 | 5/1988 |
| EP | 0 330 522 | A2 | 8/1989 |
| WO | 9213933 | A1 | 8/1992 |
| WO | 9306195 | A1 | 4/1993 |

* cited by examiner

METHOD OF INCREASING HYDROLYTIC STABILITY OF MAGNESIUM OVERBASED PRODUCTS

CROSS-REFERENCE TO RELATED APPLICATION

This application claims the benefit of U.S. Provisional Patent Application No. 60/945,794 filed Jun. 22, 2007.

TECHNICAL FIELD

The present invention relates to methods and compositions for improving magnesium overbased compositions and fuel oils containing the same, and more particularly relates to improving the hydrolytic stability of magnesium overbased compositions used in fuel oils to reduce or prevent their tendency to cause corrosion and fouling due to impurities.

TECHNICAL BACKGROUND

Fuels and fuel oils used in combustion machines such as gas turbines and diesel engines may contain impurities that cause or facilitate undesirable corrosion of the components of these systems. For example, due to the high temperatures in the "hot gas path" of a gas turbine (e.g. in the range of 580° C.-2000° C.), turbine blades and guide vanes are constructed of superalloy materials. The natural oxidation rate of these materials is relatively low which facilitates a significant component life, but if the oxidation rate is increased by the presence of corrosive deposits, then their life can be reduced to months. Sulfidation and vanadic corrosion are the two main types of accelerated high temperature corrosion mechanisms that can occur on gas turbine blades, both involving molten salt corrosion and ash melting point.

Sulfidation corrosion results from the presence of the alkali metals sodium and potassium in the presence of fuel sulfur. Vanadic corrosion is a generalized corrosion mechanism that results from the presence of vanadium in the fuel. During combustion, vanadium is oxidized to vanadium pentoxide, $V_2O_5$, which condenses on blade surfaces. Vanadium pentoxide reacts with the protective oxide film on turbine blades, which depletes the surface of its protective oxide layer. The cyclic replenishment of the oxide film on the blade surface results in a gradual "eating away" of the blade surface. Also, the severity of vanadic corrosion is significantly increased in the presence of sodium and potassium, as low melting point eutectic compounds can be formed even at 530° C.

In diesel engines utilizing contaminated fuels, high temperature corrosion of valve and valve seats combined with ash fouling of the hot gas path can cause major problems. Although vanadium pentoxide alone can be a severe problem in causing deposits/corrosion as it has a melting point within the operating temperature of diesel engines, sodium and sulfur compounds make this problem significantly worse. Deposits in a molten state will attack the metal components within a diesel engine leading to metal thinning and eventually failure of the component. Also, the build up of ash deposits in a diesel engine will impede the free flow of gases and reduce the efficiency of the turbocharger.

The use of a fuel oil additive containing magnesium in a highly reactive form allows for the safe and efficient operation of a gas turbine or diesel engine when utilizing a heavy fuel oil containing metal and sulfur contaminants. The magnesium compounds react with the vanadium, sulfur and other contaminants forming ternary compounds that are not detrimental to the system. Highly reactive magnesium compounds can counteract the effects of both ash deposition and high temperature corrosion by increasing both the fusion point of ash components that are formed and modifying the ash that does form to a soft, powdery and friable form. Such additives may be termed fireside additives because they are added to the fuel burned in the gas turbines or boilers to prevent high temperature corrosion and fouling.

During combustion of the fuel, magnesium compounds react with the vanadium oxides to form high melting point magnesium vanadates, which melt at temperatures well above those encountered in gas turbines and diesel engines. For diesel engine applications, the influence of sodium and potassium must be considered and, therefore, as the levels of sodium and potassium increase relative to vanadium, more magnesium may be required to counteract these resulting detrimental effects. Deposits that are no longer molten will not be corrosive.

It is known to add magnesium, as magnesium sulfate (epsom salt), magnesium acetate, magnesium chloride, magnesium oxide or magnesium carbonate to fuels for diesel engines and gas turbine containing vanadium to reduce the corrosion in the turbine blades. In particular, magnesium overbase additives are typically used to inhibit sulfidation and vanadic corrosion that may be caused by fuel oils containing these impurities. U.S. Pat. Nos. 4,163,728 and 4,179,383 describe stable, fluid magnesium-containing dispersions and preparations thereof by high temperature decomposition of magnesium salts of carboxylic acids to MgO in dispersant-containing fluids. However, many magnesium overbase additives are affected by the presence of water, and acidic or $CO_2$ environments and may be unstable during storage and/or use.

There is thus a need to discover new magnesium overbase additives that have improved hydrolytic stability, and which still permit the magnesium overbase additives to function as corrosion inhibitors in fuel oils.

SUMMARY

There is provided, in one non-limiting embodiment a method of producing a magnesium overbased composition that involves reacting an alkylphenol resin in the presence of alkyl amine with a mixture of an alkenyl succinic anhydride and the acid form thereof to form a mixture of reaction products. The mixture of reaction products is added to a magnesium overbased component during or after the synthesis thereof to form a hydrolytically stable magnesium overbased composition.

Further, there is provided in another non-restrictive version an improved magnesium overbased composition produced by reacting an alkylphenol resin in the presence of alkyl amine with a mixture of an alkenyl succinic anhydride and the acid thereof to form a mixture of reaction products. The mixture of reaction products is then introduced or added to a magnesium overbased component during or after the synthesis thereof to form the magnesium overbased composition.

In another non-restrictive version herein, there is provided a method of improving corrosion in the use of fuel oils that involves introducing an additive to a fuel oil where the additive includes a magnesium overbased composition that is produced by a method that includes reacting an alkylphenol resin in the presence of an alkyl amine with a mixture of an alkenyl succinic anhydride and the acid form thereof to form a mixture of reaction products, and then adding the mixture of reaction products to a magnesium overbased component during or after the synthesis thereof to form the magnesium overbased composition.

Further in a different non-limiting alternative, there is provided a fuel oil composition that has reduced corrosion-causing propensity which includes a fuel oil and a magnesium overbased composition. The magnesium overbased composition is produced by one of the methods noted above.

DETAILED DESCRIPTION

Figure 1:
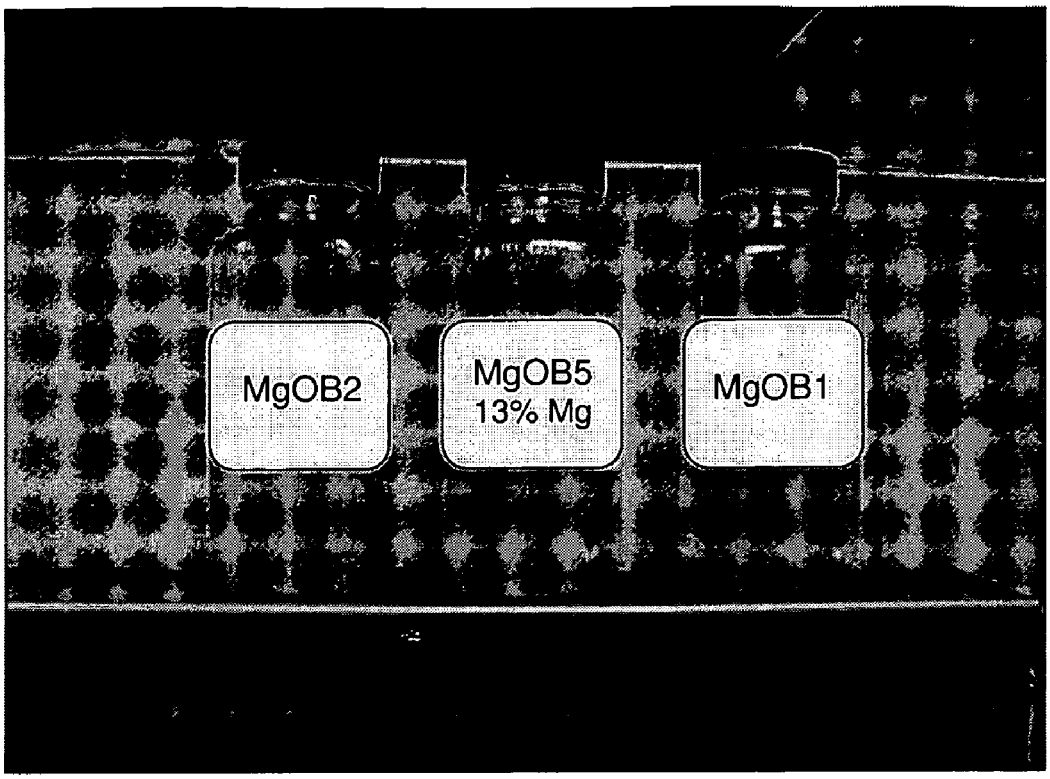
FIG. 1 is a photograph of three bottles showing white precipitate that deposits at the bottom of the bottles, where the left bottle contains MgOB2 (20% Mg), MgOB5 (13% Mg) is in the center and the right bottle contains MgOB1 (20% Mg) in sufficient amounts to give 1000 ppm on a Mg basis in diesel fuel both with no stabilizing additive.

It has been unexpectedly discovered that by reacting an alkyl phenol, such as nonyl phenol resin in the presence of an alkyl amine with a mixture of succinic anhydride, such as succininc anhydrides with carbon numbers in the range of $C_{14}$-$C_{26}$ mixed partially with their corresponding acids (up to 10 weight % acid) a mixture of reaction products is formed that in combination with a magnesium overbased composition forms a magnesium product that has significant hydrolytic stability improvement. It has also been discovered that this mixture of reaction products added to the magnesium overbased composition have in addition efficacy as asphaltene inhibitors in the ultimate fuel oil compositions. The mixture of reaction products may be added to the magnesium overbased compositions after preparation thereof or during the synthesis of the magnesium overbased composition, that is it is in situ during formation of the magnesium overbased composition.

Methods are generally known for preparing magnesium overbased compositions, dispersions thereof, and the like that are used to inhibit corrosion in fuel oils. Suitable metal additives for use in overbased compositions herein include, but are not necessarily limited to, overbases of magnesium, calcium, barium, strontium, aluminum, boron, zinc, silicon, cerium, titanium, zirconium, chromium, molybdenum, tungsten, platinum, and mixtures thereof, as well as dispersions thereof. Another group of metals include, but are not necessarily limited to magnesium, calcium, barium, strontium, aluminum, boron, zinc, silicon, cerium, titanium, zirconium, platinum, and mixtures thereof. Magnesium is found to be particularly useful. These overbases and dispersions are based in hydrocarbons, in a non-limiting example an aromatic solvent and/or diesel solvent, even though it is generally harder to get these additives dispersed in hydrocarbons as contrasted with aqueous systems. In one non-limiting embodiment, the overbased composition contains at least about 1 wt % of the metal, e.g. magnesium, calcium, barium, strontium, aluminum, boron, zinc, silicon, cerium, titanium, zirconium, chromium, molybdenum, tungsten, platinum, and combinations thereof. In one alternative embodiment, the additive contains about 5 wt % metal, in another non-limiting embodiment, the amount of metal or alkali earth metal is at least about 17 wt %, and in a different alternate embodiment, at least about 20 wt %. These overbased corrosion inhibitors are to inhibit both high temperature corrosion and to reduce gas path fouling within gas turbines, diesel engines, and the like.

In one non-limiting embodiment, the metal overbase is made by heating a tall oil with magnesium hydroxide. The overbases are colloidal suspensions. In another embodiment dispersions are made using magnesium oxide. Other suitable starting compounds besides the metal hydroxides and metal oxides include, but are not necessarily limited to, metal carboxylates, metal alkoxides and hydrocarbon-soluble metal alkyl compounds. Additionally, any metal compound that degrades, decomposes or otherwise converts to metal particles (on a nanometer scale), organometallic particles (nano), metal oxide or metal hydroxide may be employed. Dispersions and overbases made using other metals would be prepared similarly.

In further detail, the metal dispersions or complexes useful herein may be prepared in any manner known to the prior art for preparing overbased salts, provided that the overbase complex resulting therefrom is in the form of finely divided, and in one non-limiting embodiment, submicron or nanometer-sized particles which form a stable dispersion in a hydrocarbon feed stream. Thus, one non-restrictive method for preparing the additives herein is to react a base of the desired metal, e.g., $Mg(OH)_2$, with a complexing agent, e.g. a fatty acid such as a tall oil fatty acid, which is present in a quantity much less than that required to stoichiometrically react with the hydroxide, and a non-volatile diluent. The mixture is heated to a temperature of about 250-350° C., whereby there is afforded the overbase complex or dispersion of the metal oxide and the metal salt of the fatty acid. It will be appreciated that although those familiar with these overbases refer to these materials as Mg carboxylates or Mg sulfonates and the like, that they are more accurately understood as dispersions of MgO particles, rather than discrete Mg carboxylate molecules or Mg sulfonate molecules, etc.

The above described method of preparing the overbase dispersions is particularly set forth in U.S. Pat. No. 4,163,728 which is incorporated herein by reference in its entirety, wherein for example, a mixture of $Mg(OH)_2$ and a carboxylic acid complexing agent is heated at a temperature of about 280-330° C. in a suitable non-volatile diluent.

Complexing agents which are used herein include, but are not necessarily limited to, carboxylic acids, phenols, organic phosphorus acids and organic sulfur acids. Included are those acids which are presently used in preparing overbased materials (e.g. those described in U.S. Pat. Nos. 3,312,618; 2,695,910; and 2,616,904, and incorporated by reference herein) and constitute an art-recognized class of acids. The carboxylic acids, phenols, organic phosphorus acids and organic sulfur acids which are oil-soluble per se, particularly the oil-soluble sulfonic acids, are especially useful. Oil-soluble derivatives of these organic acidic substances, such as their metal salts, ammonium salts, and esters (particularly esters with lower aliphatic alcohols having up to six carbon atoms, such as the lower alkanols), can be utilized in lieu of or in combination with the free acids. When reference is made to the acid, its equivalent derivatives are implicitly included unless it is clear that only the acid is intended. Suitable carboxylic acid complexing agents which may be used herein include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids and alkyl- or alkenyl-substituted aromatic carboxylic acids. The aliphatic acids generally are long chain acids and contain at least eight carbon atoms and in one non-limiting embodiment at least twelve carbon atoms. The cycloaliphatic and aliphatic carboxylic acids can be saturated or unsaturated.

The metal additives acceptable for the methods and compositions herein also include true overbase compounds where a carbonation procedure has been done. Typically, the carbonation involves the addition of $CO_2$, as is well known in the art.

The physical form of the additive, overbase or dispersion is not critical to the practice of the compositions and methods herein as long as it may be pumped or introduced into a conduit, pipe, slipstream, unit or other equipment. More specifically, it may be in the form of a gel, a slurry, a solution, a dispersion or the like.

In one non-limiting embodiment, a suitable magnesium overbase is a colloidal suspension of MgO that are from about 40 to about 200 nanometers in size, depending on the exact manufacturing process. In one version, magnesium hydroxide is reacted with a carboxylic acid, e.g. mostly tall oil in a solvent system that is an aromatic solvent. Since on a stoichiometric basis there is a surplus of MgO to carboxylic acid, the product is called an overbase.

Of particular utility to improve the hydrolytic stability of these magnesium overbases or dispersions are mixtures of reaction products of the reaction of an alkylphenol resin in the presence of an alkyl amine with a mixture of alkenyl succinic anhydride/acids (i.e., the corresponding acid form of the alkenyl succinic anhydride). It is believed that reaction products may be formed by reacting components from these three classes, although it is not desired that the methods and compositions herein are limited by any particular explanation or theory.

In one non-limiting embodiment the ratio of alkylphenol resin to alkenyl succinic anhydride ranges from about 10:1 to about 0.05:1 by volume, while in an alternative version of the method, the ratio of alkylphenol resin to succinic anhydride ranges from about 3:1 to about 0.5:1 by volume, where in some cases a 3:1 ratio by volume may give the best results.

Suitable alkylphenol resins to make the mixture of reaction products useful herein include, but are not necessarily limited to nonylphenol resins, butylphenol resins, amylphenol resins, dinonylphenol resins and the like and mixtures thereof. Suitable succinic anhydrides useful to make the mixture of reaction products useful herein include, but are not necessarily limited to alkenyl succinic anhydrides with carbon number in the $C_{14}$-$C_{26}$ range. It has been discovered that particularly useful for the efficiency of forming the mixture of reaction products is the use of mixture of the succinic anhydrides mixed partially with their acidic counterparts. In one alternative embodiment the acidic contribution was discovered as being up to 10 weight % or even up to 20 wt %. In one non-restrictive version, the mixture of alkenyl succinic anhydride and the corresponding acid is about 80 to about 99 wt % succinic anhydride and from about 20 to about 1 wt % corresponding acid. One suitable ratio of alkenyl succinic anhydride to acid is about 91/9 by weight. In another non-limiting version, a suitable amount of the acid form of the C14 to C26 alkenyl succinic anhydride may be up to 7 weight % of the mixture of the alkenyl succinic anhydride and the corresponding acid form thereof. In another non-restrictive version, the alkenyl succinic anhydride and the acid form thereof may have from 16 carbon atoms independently up to 24 carbon atoms. Suitable alkenyl succinic anhydrides include, but are not necessarily limited to, iso-octadecenyl succinic anhydride (IODSA), dodecenyl succinic anhydride (DDSA), polyisobutenyl succinic anhydride (PIBSA) and the like and mixtures thereof. It has been discovered that mixtures of reaction products of nonylphenol in the presence of an alkyl amine reacted with this latter group of alkenyl succinic anhydrides/acid mixtures have particular utility in increasing hydrolytic stability of magnesium sulfonate overbased components. In one non-limiting embodiment, the alkyl amine is a secondary alkyl amine. Suitable secondary alkyl amines include, but are not necessarily limited to, diethylene triamine (DETA), triethylene tetramine (TETA), tetraethylene pentamine (TEPA) and mixtures thereof. In another non-restrictive version, the proportion of amine to include with the other reactants (alkylphenol and alkenyl succinic anhydride) is from about 0.5 to about 10 wt % (alternatively, a suitable concentration of amine used is in the range of 1-2 wt %). It will be appreciated that although the reactants are discussed in the singular, e.g. "an alkylphenol resin", "an alkyl amine and "an alkenyl succinic anhydride and the acid thereof", that more than one of these types of reactants may be used to form the mixture of reaction products.

The mixing or reaction of these three components may be conducted at atmospheric pressure and at ambient temperature, or at a temperature in the range of from about 25° C. to about 90° C. No catalyst is required for the components to be effective.

In one non-limiting embodiment, from about 1 to about 30 wt % of the mixture of reaction products of the alkylphenol resin and alkyl amine reacted with the mixture of alkenyl succinic anhydride/acid should be added to the magnesium overbase component to give the concentrated product. In an alternative version, the amount of mixture of reaction products introduced or added based on the magnesium overbase ranges from about 3 independently up to about 15 wt %, alternatively from about 5 wt % as the lower threshold independently up to about 10 wt %. The overbased compositions should be of a viscosity suitable to permit ease of handling and pumping.

With respect to treating the fuel oil or other fuel to reduce or eliminate or prevent corrosion when the fuel is combusted, the amount of magnesium overbase composition (containing the mixture of reaction products herein) may involve adding at least 3 parts Mg to every part vanadium (V) in the fuel. Not all of the magnesium overbased composition is active Mg. Thus, if a composition is 20% active, then about 15 ppm of composition is added per 1 ppm V present. In treating a fuel with 200 ppm V, the magnesium overbased composition introduced may be 3000 ppm. In boilers, the magnesium overbased composition may also help with $SO_3$ and sulfuric acid emission problems.

To give some idea of suitable proportions, from about 10 to about 5000 ppm by weight of the magnesium overbased composition based on the fuel oil may be employed, in one non-limiting embodiment. In another non-restrictive version, the amount of the magnesium overbased composition ranges from about 15 to about 3500 ppm.

In general, the magnesium overbased compositions may be added at any convenient location upstream of the gas turbine or diesel engine. Adequate mixing of the additive should be ensured to achieve a homogeneous solution of additized fuel. Again, the recommended dosage of overbased additive depends upon the particular application. In one non-limiting embodiment, for gas turbines, a minimum of 15 ppm of product by weight for each ppm of vanadium present in the fuel may be used. In diesel engines, a minimum of 5 ppm of product by weight per 1 ppm of the total metal contaminants (V, Pb, Na, K) may be employed.

It has also been discovered that the tendency of the fuel oil to precipitate asphaltenes is decreased (an improvement) when this new magnesium product will be applied (due to the presence of the mixture of reaction products formed) as compared with an otherwise identical fuel oil composition absent of the mixture of reaction products. The proportions of mixture of reaction products in the magnesium overbase composition to achieve the asphaltene inhibitor effect is similar to those described earlier as useful to serve to improve hydrolytic stability.

The invention will now be illustrated with respect to certain examples which are intended merely to illustrate and illuminate the invention more fully and not limit it in any way.

EXAMPLES

In order to test and improve the hydrolytic stability of Mg overbased products, a series of laboratory-made formulations were run through the hydrolytic stability test (HST). The HST used was a proprietary version similar to what is publicly known for HS tests used by General Electric and Serma Technologies.

The HST was performed at room temperature as well as high temperature, namely 90° C. Either #1 or #2 diesel fuel maybe used for testing. In this particular case an ultra-low sulfur diesel summer as well as winter version, with no additives was mainly used in the testing. The fuel was received from Exxon Mobil. Data were obtained on the filtered fuel as well as from the unfiltered fuel. For the filtration of the fuel a 0.45 μm Millipore filter paper was used.

TABLE 1

HST data for reference samples at 25° C. (RT) and 90° C. (HT) without $H_2O$

| Sample | Time (sec) | Volume left |
|---|---|---|
| Diesel | 5, 10 | 0 |
| Diesel + MgOB3 (30 ppm Mg) RT | 8 | 0 |
| Diesel + MgOB3 (300 ppm Mg) HT | 8 | 0 |
| Diesel + MgOB4 (30 ppm Mg) RT | 6 | 0 |
| Diesel + MgOB4 (30 ppm Mg) HT | 9 | 0 |
| Diesel + MgOB2 (300 ppm Mg) HT | 5, 6 | 0 |
| Diesel + MgOB2 (300 ppm Mg) HT | 8, 7 | 0 |
| Diesel + MgOB1 RT | — | 0 |

RT = room temperature;
HT = high temperature

By performing the HST measurements from Table 1 the baseline with respect to currently existing additives and their response in the HST without the presence of water was established. Thus, the influence of water on their performance could be further investigated. An amount of 0.1% $H_2O$ was selected to be used in all the experiments. This was established according with the GEK 28150d test procedure used by Serma Technologies as well as a brochure published by Chemtura (formerly Wittco) with respect to the HYBASE® M-14D overbase product.

Table 2 presents the HST data obtained for these additives in the presence of water. In order to quantify the performance of the additives in the HST a filtration index was defined according to the GEK 28150d procedure. Filtration index values were derived and are presented in Table 2. FI<2 indicate a pass in the HST; FI>2 indicate a fail of the HST.

TABLE 2

HST data for reference samples at 25° C. (RT) and 90° C. (HT) with 0.1% $H_2O$; 3 h

| Sample | Time (sec) | FI (filtration index) | Volume left (mL) |
|---|---|---|---|
| Diesel + $H_2O$ (RT) | 8; 9 | N/A | 0 |
| Diesel + $H_2O$ (HT) | 7 | N/A | 0 |
| Diesel + $H_2O$ + MgOB3 (RT) | 10; 9 | 1.25; 1 | 0 |
| Diesel + $H_2O$ + MgOB3 (HT) | 7; 24 | 1; 3.42 | 0 |
| Diesel + $H_2O$ + MgOB4 (RT) | 9; 9 | 1.125; 1 | 0 |
| Diesel + $H_2O$ + MgOB4 (HT) | >120; >120; >120 | >2; >2; >2 | 20; 34 71 |
| Diesel + $H_2O$ + MgOB2 (300 ppm Mg) RT | — | — | — |
| Diesel + $H_2O$ + MgOB2 (300 ppm Mg) HT | >120; >120 | >2; >2 | 33; 79 |
| Diesel + $H_2O$ + MgOB2 (300 ppm Mg) RT | 18 | 2.1 | 0 |
| Diesel + $H_2O$ + MgOB2 (300 ppm Mg) HT | >120 | >2 | 0 |
| Diesel + $H_2O$ + MgOB1 (300 ppm Mg) RT | 40 | 5 | 0 |
| Diesel + $H_2O$ + MgOB1 (300 ppm Mg) HT | >120 | >2 | N/A |

Initial results from the HST indicated that at room temperature all the additives investigated (Mg-sulphonate as well as Mg-carboxylate based) performed well. Clear differences in the performance of the investigated products were noticed only for the samples heated at 90° C. at different reaction times. Thus, the Mg-sulphonate product showed similar performance at 25° C. as well as 90° C. On contrary, the Mg-carboxylate product revealed significant differences in the HST performance at 25° C. versus 90° C.

The reference additives investigated were as noted in the Glossary. Table 1 summarizes the data for the HST taken for the reference samples. In all of these samples no water was present. The time reported is the time it takes to filter a 100 ml sample through 0.8 μm Millipore filter paper.

As it can be noticed after performing these measurements, it was clear that the performance of MgOB2, MgOB4 or MgOB1 was not good enough to pass the HST.

On the contrary, the MgOB3 product behaved very well in the preliminary tests. To confirm this behavior and to have sufficient data, a full set of HST data was acquired using two different Mg concentrations of 300 ppm and 1000 ppm, respectively on the MgOB3 product. Table 3 shows HST data obtained and the filtration index values calculated for each sample. It may be noticed in all the HST trials the MgOB3 product performed very well and it passed the HST every time. The FI values obtained for this product were all less than 2.

TABLE 3

HST Data for MgOB3 Product

| Sample | Time | FI |
|---|---|---|
| Diesel + 0.1% DI $H_2O$ - RT | 17 sec | N/A |
| Diesel + 0.1% DI $H_2O$ + MgOB3 (1000 ppm Mg) - RT | 9 sec | 0.53 |
| Diesel + 0.1% DI $H_2O$ - 90° C. | 10 sec | N/A |
| Diesel + 0.1% DI $H_2O$ + MgOB3 (1000 ppm Mg) - 90° C. | 12 sec | 1.2 |
| Diesel + 0.1% DI $H_2O$ + MgOB3 (1000 ppm Mg) - 90° C. | 13 sec | 1.3 |
| Diesel + 0.1% DI $H_2O$ + MgOB3 (1000 ppm Mg) - 90° C. | 11 sec | 1.1 |
| Diesel + 0.1% DI $H_2O$ + MgOB3 (300 ppm Mg) - 90° C. | 13 sec | 1.3 |
| Diesel + 0.1% DI $H_2O$ + MgOB3 (300 ppm Mg) - 90° C. | 15 sec | 1.5 |
| Diesel + 0.1% DI $H_2O$ + MgOB3 (300 ppm Mg) - 90° C. | 8 sec | 0.8 |
| Diesel + 0.1% DI $H_2O$ + MgOB3 (300 ppm Mg) - 90° C. | 15 sec | 1.5 |

Seeing the high performance of MgOB3 in the HST and the deficiency of MgOB2 and MgOB1 additives, respectively, it was clear that an important focus needed to be addressed and understanding of the chemical behavior in the presence of water of these two additives needed to be considered. Due to this reason, an intense search and lab work were performed in order to find suitable ways to improve the performance of these additives in the HST.

Significant difficulties were encountered in assessing the reliability of the HST as a screening tool. Many factors were involved in this process. Another main constraint was due to insufficient amounts of diesel available to use in testing. It was found that significant changes in the performance of the HST can appear by changing the diesel used to perform the test. Additionally, the lack of information regarding the HST protocols used by others was part of the challenge to be overcome.

A long list of candidates was investigated during this step. The list is presented in Table 4. The first column shows the candidates that were screened and that did not perform well in the test. The second column represents the candidates that were screened and gave a good performance or had potential to be used in the formulation to enhance the overall performance of the MgOB2 or MgOB1 additives, respectively.

TABLE 4

Potential Candidates Used in Conjunction with MgOB2 or MgOB1 to Improve HST Response

| Candidates Screened | Promising Candidates |
|---|---|
| Nonylphenol resin intermediate, emulsion breakers | Uncatalyzed resin |
| Fuel additive available from Baker Petrolite | NPR4 |
| Butyl resin intermediate | NPR3 |
| Oleic Acid, Adipic Acid, Glycolic Acid | NPR2 |
| Tert-Butyl Phenol, Dinitro-phenol, Para-nitroso-phenol | Citric Acid in $H_2O$/EtOH |
| n-octenyl succinic anhydride | succinic anhydrides (SA) with carbon number in the range of $C_{14}$-$C_{26}$ |
| Dodecenyl succinic anhydride (DDSA) | succinic anhydrides (SA) with carbon number in the range of $C_{14}$-$C_{26}$/ succinic acids with $C_{14}$-$C_{26}$ |
| Pentaerythritol distearate | IODSA - iso-octadecenyl succinic anhydride |
| Dipentaerythritol | |
| TWEEN ® 80 nonionic emulsifier available from ICI Americas | |
| Butyl resins available from Baker Petrolite | |
| PAO 72 available from Baker Petrolite | |
| Glycerin | |
| Unidyme 185 carboxylic acid available from Arizona Chemical Co. | |
| 2-methoxyethanol | |
| 2-ethylhexanol | |
| butyl-carbitol | |
| Amine-neutralized sulfonate | |
| Aromatic solvent | |
| Polyalkyl succinic imide | |
| PIBSA of 2 different grades | |

Based on the results above, a series of formulations were pursued using the promising candidates. The HST needs to be run using #1 or #2 diesel without additives. A list with the combinations tried that gave good results is presented in Table 5:

TABLE 5

Combinations of Promising Candidates to Reformulate MgOB1

| Ex. | Combination in diesel + 0.1% $H_2O$ | HST Result-Time (sec) |
|---|---|---|
| 1 | MgOB2+ NPR4 (70:30 v/v, 214 μL) | 13; 19; |
| 2 | MgOB2+ PAO 72 (70:30 v/v, 214 μL) | 7; 9 |
| 3 | MgOB2 (150 μL) + NPR4 (64 μL) | 13 |
| 4 | MgOB2 (150 μL) + PAO 72 (64 μL) | 9 |
| 5 | MgOB2 (900 μL) + NPR4/IODSA/Acid(2) (390 μL) (1 h only) | >1 min; 10 mL left |
| 6 | MgOB2 (3 mL) + IODSA/Acid (1 mL) | =2 min; 1 mL left |
| 7 | MgOB2 (214 μL) + NPR3/Citric Ac/EtOH(1) (214 μL) | 14, 13 |
| 8 | MgOB1 (3 mL) + NPR4/IODSA/Acid (260 μL) | 15, 20, 19, 10, 15 |
| 9 | MgOB1 (3 mL) + NPR4/IODSA/Acid (260 μL) | 13 |
| 10 | MgOB1 (3 mL) + NPR2 (260 μL) + IODSA/Acid(2) (260 μL) | 20, 10 |
| 11 | MgOB1 (3 mL) + NPR4/IODSA/Acid(1) (260 μL) | 10 |

For Examples 1-5, the proportions were adjusted so that the Mg contents were all 300 ppm; for Examples 6-11, the proportions were adjusted so that the Mg contents were all 1000 ppm. The amount of acid in the IODSA/Acid mixture was about 6 wt %.

As may be seen, the best combinations found in terms of the HST performance are given by MgOB1 mixed with NPR4 and IODSA/Acid or MgOB1 mixed with NPR2 and IODSA/Acid. The filter paper with the residual collected after the HST was also analyzed by running it through ATR-FTIR (Attenuated Total Reflectance coupled with Fourier Transform Infrared Spectroscopy). It was interesting to notice a significant reduction in the $Mg(OH)_2$ intensity peak only for the combination of MgOB2/NPR4/IODSA/Acid. It is also important to point out that both MgOB2/NPR4 and MgOB2/IODSA/Acid combinations did not perform as well in the HST and a fail was recorded for those in spite of a series of concentration ratios that were tried. The concentration effect of the chemicals in terms of their blending ratios was also reviewed. It seems that by using different concentrations ratios of the NPR4/IODSA/Acid or NPR1/IODSA/Acid mixtures, changes in the performance of the HST are noticeable. The best ratio found was a mixture of NPR4:IODSA/Acid=3:1 (by volume) or NPR1:IODSA/Acid=3:1 (by volume). In addition to concentration effect we also look into the effect of temperature. The response of different combinations was evaluated at different heating times and clear differences were noticed with respect to their HST behavior. A suitable heating time found from those data was about 3 hours.

In addition to the HST experiments, pictures were taken of the mixtures of the above combinations and some observations were conducted by naked-eye inspection. It is clear that after MgOB1 or MgOB2 was kept in an oven for 3 hours dispersed in the diesel/water emulsion without any extra additive added that a significant amount of white precipitate forms and deposits at the bottom of the jars. This precipitate was mainly $Mg(OH)_2$, which precipitate also hinders the filtration test. A photograph showing such precipitate is seen in FIG. 1, where the left bottle contains MgOB2 (20% Mg) and the right bottle contains MgOB1 (20% Mg), to give 1000 ppm Mg total concentration for both compositions.

Figure 2:
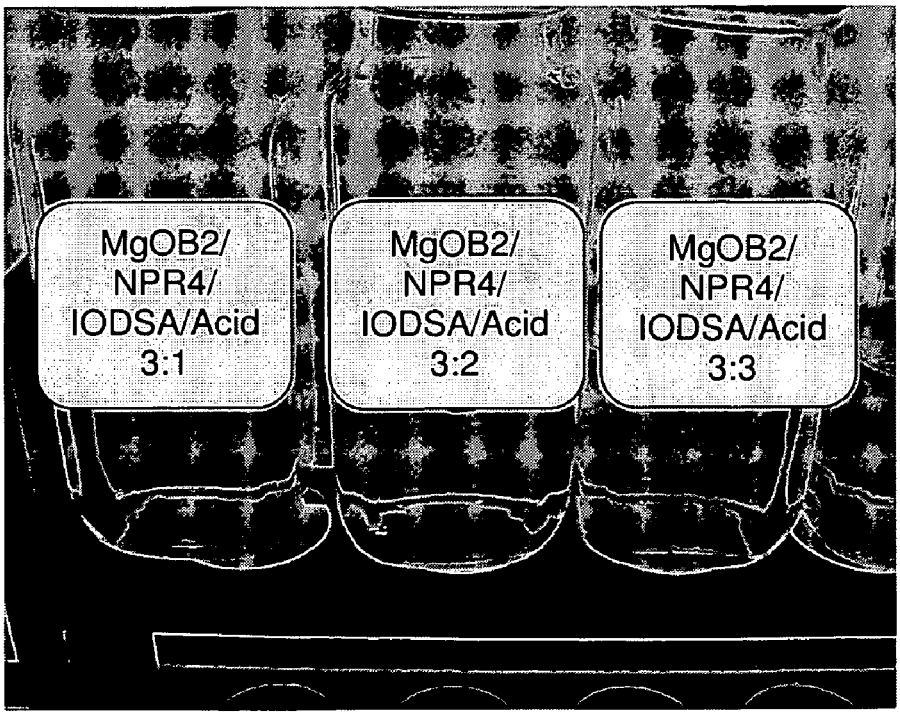
FIG. 2 is a photograph of three bottles showing a brighter, clearer yellow solution having no precipitate or thin film layer in the bottoms of the bottles, where the bottles contain MgOB2 (20% Mg) mixed with NPR4/IODSA (iso-octadecenyl succinic anhydride, including the corresponding acid thereof) at different concentration ratios, but on the same Mg concentrations in diesel fuel as the samples of FIG. 1.

By using the combinations presented above, the appearance of the solutions generated with the additive was completely changed. Relatively brighter, clearer yellow solutions were observed after adding either NPR4/IODSA/Acid or NPR1/IODSA/Acid. No precipitate or thin film layer was noticed at the bottom of the jars, as shown in the photograph of FIG. 2.

Not enough chemical characterization examples were performed to explain and understand the reason behind these results and behavior.

In one non-limiting embodiment, it is believed that more reaction products are forming by reacting the nonyl phenol resin in the presence of alkyl amine with the anhydride/acid mixture. It was identified that the amine reacts fully with the anhydride present in the system. Evidence of generating more acid in the system upon their reaction is also present. Reaction between the nonyl phenol resin and the anhydride portion is also taking place.

One possible, non-limiting explanation of the results is that due to the presence of this mixture of reaction products formed by reacting phenol resin in the presence of amine and the anhydride/acid mixture that MgO conversion to $Mg(OH)_2$ is inhibited and no significant particle growth is induced. In addition, in another non-restrictive explanation, it may be that another stability component to the system is introduced. It was proven in previous work that the presence of reaction products formed by reacting phenol resin in the presence of amine in a fuel oil system prevents asphaltene to precipitate and helps them to remain dispersed in the fuel.

The inventors do not wish to be limited to either one of these potential explanations.

In the foregoing specification, the invention has been described with reference to specific embodiments thereof. It has been demonstrated that the reaction of an alkylphenol resin in the presence of an alkyl amine reacted with a mixture of an alkenyl succinic anhydride and the corresponding acid thereof forms a mixture of reaction products that, introduced to a magnesium overbased composition, can improve the hydrolytic stability of the overbase. However, it will be evident that various modifications and changes may be made thereto without departing from the broader spirit or scope of the invention as set forth in the appended claims. Accordingly, the specification is to be regarded in an illustrative rather than a restrictive sense. For example, specific combinations of alkylphenol resins, alkyl amines, alkenyl succinic anhydride, alkyl succinic acids, solvents, magnesium overbased compositions, and other components falling within the claimed parameters, but not specifically identified or tried in a particular composition or under specific conditions, are anticipated to be within the scope of this invention.

The present invention may suitably comprise, consist or consist essentially of the elements disclosed and may be practiced in the absence of an element not disclosed.

The words "comprising" and "comprises" as used throughout the claims is to interpreted "including but not limited to".

GLOSSARY OF COMPOSITION TERMS

| | |
|---|---|
| MgOB1 | Magnesium carboxylate overbase intermediate having about 27.5% Mg. |
| MgOB2 | About 20% MgO active product made by diluting MgOB1with aromatic solvent. |
| MgOB3 | A commercial Mg-sulfonate-based product available from Baker Petrolite. |
| MgOB4 | About 25% MgO active product made by diluting MgOB1 with aromatic solvent. |
| NPR1 | Nonylphenol resin containing <1% NaOH. |
| NPR2 | Nonylphenol resin containing no NaOH and alkyl amine. |
| NPR3 | Nonylphenol resin containing no NaOH made at a different pilot plant than NPR2 and alkyl amine. |
| NPR4 | Dispersant product made from NPR3 by dilution with 30% toluene and 1.8% triethylenetetramine. |
| MgOB5 | About 13% MgO active product made by diluting MgOB1with aromatic solvent |

What is claimed is:

1. A magnesium overbased composition produced by a method comprising:

reacting an alkylphenol resin in the presence of an alkyl amine with a mixture of an alkenyl succinic anhydride and an acid thereof to form a mixture of reaction products; and adding the mixture of reaction products to a magnesium overbased component during or after the synthesis thereof to form the magnesium overbased composition.

2. The magnesium overbased composition of claim 1 further comprising a solvent selected from the group consisting of an aromatic solvent, a diesel solvent, and mixtures thereof.

3. The magnesium overbased composition of claim 1 where the hydrolytic stability of the magnesium overbased composition is improved as compared with an otherwise identical composition absent the mixture of reaction products.

4. The magnesium overbased composition of claim 1 where the alkylphenol resin is a nonylphenol resin, the alkyl amine is a secondary alkyl amine, the alkenyl succinic anhydride-acid mixture comprises an alkenyl succinic anhydride and an acid thereof with a carbon number ranging from 14 to 26 where the acid content of the alkenyl succinic anhydride-acid mixture is up to 10 weight % of the mixture, and the magnesium overbased component comprises magnesium sulfonate.

5. The magnesium overbased composition of claim 1 where the alkylphenol resin is a nonylphenol resin and the alkenyl succinic anhydride is iso-octadecenyl succinic anhydride.

6. A magnesium overbased composition produced by a method comprising:

reacting a nonylphenol resin in the presence of an alkyl amine with a mixture of an alkenyl succinic anhydride and the acid thereof having from 14 to 26 carbon atoms, to form a mixture of reaction products; and adding the mixture of reaction products to a magnesium sulfonate overbase component during or after the synthesis thereof to form the magnesium overbased composition, where the hydrolytic stability of the magnesium overbased composition is improved as compared with an otherwise identical composition absent the alkylphenol resin/succinic anhydride mixture or reaction product.

7. A method of improving corrosion in the use of fuel oils comprising introducing an additive to a fuel oil, where the additive comprises a magnesium overbased composition produced by a method comprising:

mixing an alkylphenol resin in the presence of an alkyl amine with a mixture of an alkenyl succinic anhydride and an acid thereof to form a mixture of reaction products;

adding the mixture of reaction products to a magnesium overbased component during or after the synthesis thereof to form the magnesium overbased composition.

8. The method of claim 7 where the magnesium overbased composition further comprises a solvent selected from the group consisting of an aromatic solvent, a diesel solvent, and mixtures thereof.

9. The method of claim 7 where the hydrolytic stability of the magnesium overbased composition is improved as compared with an otherwise identical composition absent the mixture of reaction products.

10. The method of claim 7 where the alkylphenol resin is a nonylphenol resin, the alkyl amine is a secondary alkyl amine, the alkenyl succinic anhydride acid mixture comprises an alkenyl succinic anhydride and an acid thereof with a carbon number ranging from 14 to 26 where the acid content of the alkenyl succinic anhydride-acid mixture is up to 10 weight % of the mixture, and the magnesium overbased component comprises magnesium sulfonate.

11. The method of claim 7 where the alkylphenol resin is a nonylphenol resin and the alkenyl succinic anhydride is iso-octadecenyl succinic anhydride.

12. The method of claim 7 where the amount of magnesium overbased composition in the fuel oil ranges from about 10 to about 5000 ppm by weight based on the fuel oil.

13. A fuel oil composition having a reduced corrosion-causing propensity comprising:

fuel oil; and a magnesium overbased composition produced by a method comprising:

reacting an alkylphenol resin in the presence of an alkyl amine with a mixture of an alkenyl succinic anhydride and an acid thereof to form a mixture of reaction products; and adding the mixture of reaction products to a magnesium overbased component during or after the synthesis thereof to form the magnesium overbased composition.

14. The fuel oil composition of claim 13 where the magnesium overbased composition further comprises a solvent selected from the group consisting of an aromatic solvent, a diesel solvent and mixtures thereof.

15. The fuel oil composition of claim 13 where the hydrolytic stability of the magnesium overbased composition is improved as compared with an otherwise identical composition absent the mixture of reaction products.

16. The fuel oil composition of claim 13 where the fuel oil composition has a decreased tendency to precipitate asphaltenes as compared with an otherwise identical composition absent the mixture of reaction products.

17. The fuel oil composition of claim 13 where the alkylphenol resin is a nonylphenol resin, the alkyl amine is a secondary alkyl amine, the alkenyl succinic anhydride acid mixture comprises an alkenyl succinic anhydride and an acid thereof with a carbon number ranging from 14 to 26 where the acid content of the alkenyl succinic anhydride-acid mixture is up to 10 weight % of the mixture, and the magnesium overbased component comprises magnesium sulfonate.

18. The fuel oil composition of claim 13 where in the magnesium overbased composition, the alkylphenol resin is nonylphenol resin and the alkenyl succinic anhydride is iso-octadecenyl succinic anhydride.

19. The fuel oil composition of claim 13 where the amount of magnesium overbased composition in the fuel oil ranges from about 10 to about 5000 ppm by weight based on the fuel oil.

20. A fuel oil composition having reduced corrosion-causing propensity comprising:

fuel oil; and from about 10 to about 5000 ppm by weight based on the fuel oil of a magnesium overbased composition produced by a method comprising:

reacting an nonylphenol resin in the presence of an alkyl amine with a mixture of an alkenyl succinic anhydride and an acid thereof having from 14 to 26 carbon atoms to form a mixture of reaction products; and adding the mixture of reaction products to a magnesium sulfonate overbased component during or after the synthesis thereof to form the magnesium overbased composition.

21. A method of producing a magnesium overbased composition comprising:

reacting an alkylphenol resin in the presence of an alkyl amine with a mixture of an alkenyl succinic anhydride and an acid thereof to form a mixture of reaction products;

adding the mixture of reaction products to a magnesium overbased component during or after the synthesis thereof to form the magnesium overbased composition.

22. The method of claim 21 further comprising a solvent selected from the group consisting of an aromatic solvent, a diesel solvent, and mixtures thereof.

23. The method of claim 21 where the hydrolytic stability of the magnesium overbased composition is improved as compared with an otherwise identical composition absent the mixture of reaction products.

24. The method of claim 21 where the alkylphenol resin is a nonylphenol resin, the amine is a secondary alkyl amine, the alkenyl succinic anhydride-acid mixture comprises an alkenyl succinic anhydride and an acid thereof with a carbon number ranging from 14 to 26, where the acid content of the alkenyl succinic anhydride-acid mixture is up to 10 weight % of the mixture, and the magnesium overbased component comprises magnesium sulfonate.

25. The method of claim 21 where the alkylphenol resin is a nonylphenol resin and the succinic anhydride and the acid thereof have carbon numbers in the range from 14 to 26.

* * * * *